US009070290B2

(12) United States Patent
Taylor

(10) Patent No.: US 9,070,290 B2
(45) Date of Patent: Jun. 30, 2015

(54) APPARATUS AND SYSTEM FOR MONITORING AND MANAGING TRAFFIC FLOW

(71) Applicant: Donald Warren Taylor, Arlington, TX (US)

(72) Inventor: Donald Warren Taylor, Arlington, TX (US)

( * ) Notice: Subject to any disclaimer, the term of this patent is extended or adjusted under 35 U.S.C. 154(b) by 131 days.

(21) Appl. No.: 13/815,807

(22) Filed: Mar. 16, 2013

(65) Prior Publication Data

US 2014/0278026 A1 Sep. 18, 2014

(51) Int. Cl.

| | |
|---|---|
| ***G08G 1/08*** | (2006.01) |
| ***G08G 1/01*** | (2006.01) |
| ***G08G 1/087*** | (2006.01) |

(52) U.S. Cl.

CPC ..... *G08G 1/08* (2013.01); *G08G 1/0112* (2013.01); *G08G 1/0116* (2013.01); *G08G 1/0133* (2013.01); *G08G 1/0145* (2013.01); *G08G 1/087* (2013.01)

(58) Field of Classification Search

CPC ..... G08G 1/08; G08G 1/0112; G08G 1/0116; G08G 1/087

USPC ..... 701/117, 119, 200

See application file for complete search history.

(56) References Cited

U.S. PATENT DOCUMENTS

| | | | | |
|---|---|---|---|---|
| 2010/0274448 | A1* | 10/2010 | Ueno et al. | 701/36 |
| 2011/0224898 | A1* | 9/2011 | Scofield et al. | 701/200 |
| 2012/0035839 | A1* | 2/2012 | Stehle et al. | 701/117 |

* cited by examiner

*Primary Examiner* — Fadey Jabr
*Assistant Examiner* — Yazan A Soofi

(57) ABSTRACT

An apparatus and system for monitoring and managing traffic flow. The system includes a plurality of remote sensor devices arranged in a plurality of vehicles, a plurality of remote communication devices arranged along one or more roadways and in communication with the plurality of remote sensor devices, a central server, a network interface in communication with the central server and the plurality of remote communication devices over a network, and a shared database in communication with the central server. The central server is configured to receive traffic data from the plurality of remote sensor devices over the network, update traffic data in the shared database, periodically calculate an optimal traffic flow for one or more of vehicles traveling along the one or more roadways based on the updated traffic data, and transmit timing adjustments over the network to one or more traffic light intersections based on the optimal traffic flow calculations. The network interface is configured to send and receive traffic data, wherein the traffic data includes vehicle location information.

2 Claims, 3 Drawing Sheets

APPARATUS AND SYSTEM FOR MONITORING AND MANAGING TRAFFIC FLOW

BACKGROUND OF THE INVENTION

1. Field of the Invention

The present invention is generally related to transportation, and more particularly to an apparatus and system for monitoring and managing traffic flow.

2. Discussion of the Background

With ever increasing road traffic levels there is a particular need for the monitor and manage traffic congestion. Existing systems generally depend on direct visual observations and manual input. Such techniques can only provide extremely limited management of vehicles and are too imprecise for more sophisticated management of traffic flow and are generally not automated.

Thus, there currently exist deficiencies in monitoring and managing traffic flow.

SUMMARY OF THE INVENTION

Accordingly, one aspect of the present invention is to provide a system for monitoring and managing traffic flow. The system includes (i) a plurality of remote sensor devices arranged in a plurality of vehicles, (ii) a plurality of remote communication devices arranged along one or more roadways and in communication with the plurality of remote sensor devices, (iii) a central server, (iv) a network interface in communication with the central server and the plurality of remote communication devices over a network, and (v) a shared database in communication with the central server. The central server is configured to: (i) receive traffic data from the plurality of remote sensor devices over the network, (ii) update traffic data in the shared database, (iii) periodically calculate an optimal traffic flow for one or more of vehicles traveling along the one or more roadways based on the updated traffic data, and (iv) transmit timing adjustments over the network to one or more traffic light intersections based on the optimal traffic flow calculations. The network interface is configured to send and receive traffic data, wherein the traffic data includes vehicle location information, Another aspect of the present invention is to provide a method for a computer program product embodied on a computer readable medium for monitoring and managing traffic flow. The computer program product includes (i) a first computer code for receiving traffic data from a plurality of remote communication devices arranged along one or more roadways and in communication with a plurality of remote sensor devices arranged in a plurality of vehicles over a network, (ii) a second computer code for updating traffic data in a shared database, (iii) a third computer code for periodically calculating an optimal traffic flow for one or more of vehicles traveling along the one or more roadways based on the updated traffic data, and (iv) a fourth computer code for transmitting timing adjustments over the network to one or more traffic light intersections based on the optimal traffic flow calculations. Each of the plurality of remote sensor devices comprise an RFID and a GPS module.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, wherein.

DETAILED DESCRIPTION THE PREFERRED EMBODIMENTS

Figure 1A:
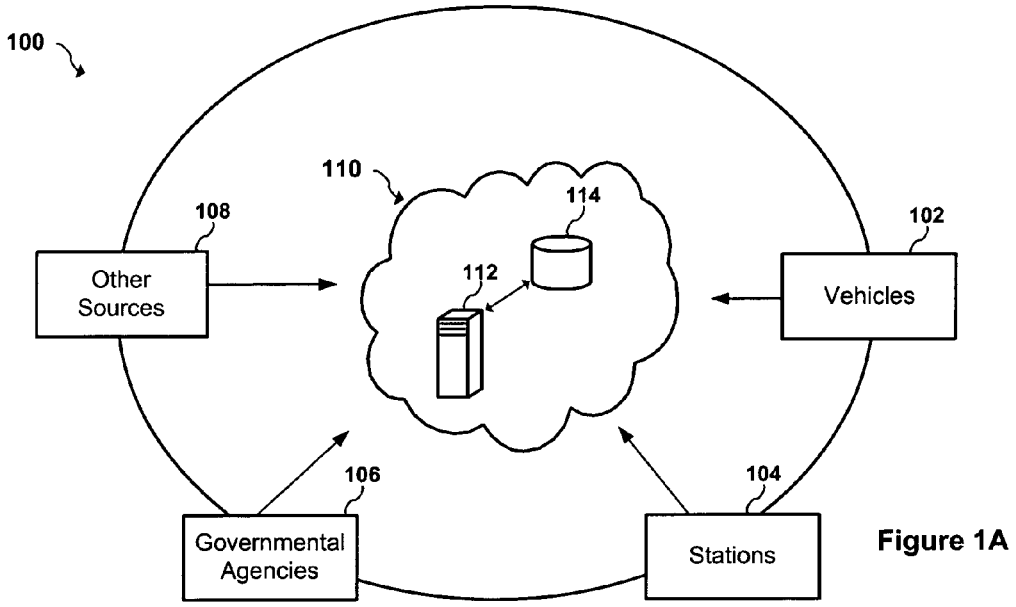
FIGS. 1A-1B are block diagrams illustrating a system for monitoring and managing traffic flow in accordance with an embodiment of the present invention.

Referring now to the drawings, wherein like reference numerals designate identical or corresponding parts throughout the several views, preferred embodiments of the present invention are described.

The present invention relates to an apparatus and system for monitoring and managing traffic flow in a road network in an area served by one or more receiving stations receiving geographic positional data from one or more vehicles. According to one embodiment, the geographic positional data from one or more vehicles may utilize devices having the Autovecth Integrated Chip Set (RFIDGPS), also referred to "AVICS" devices. According to other embodiments, the geographic positional data is received from commercially available consumer devices, such as without limitation, mobile phones, smart phones, PDAs and the like. The geographic positional data may be in the form of a geographical position such as latitude and longitude, or may be other forms which can be converted into such a form. The information collected on the progress of the individual vehicles can be used to calculate the average speeds and transit times of the vehicles. The data may also include fuel consumption data, maintenance information, mechanical information from onboard vehicle processors, emergency information, and the like.

Receiving stations include one or more sensors and/or receivers strategically placed along roadway locations. As used herein, roadway locations include, without limitation, municipal traffic lights, lighting circuits, camera feeds from local highways, roads, freeways and interstate roads, landmarks, municipal buildings, freeway mile markers and other common areas.

According to the present invention, existing wired and wireless networks, wide area networks, ad-hoc networks, and systems may be modified for continuous data feeds from one or more receiving stations woven into a dynamic computational algorithmic architecture. According to one possible embodiment, communication is received from one or more communication devices, sometimes referred to as tVector Hubs, strategically placed at roadway locations. The network may optionally be enhanced to handle the network data necessary to manage the traffic flow in real time. Such data includes data received from, and/or to, the one or more sensors, receivers and/or vehicles. Traffic flow management includes automatically presenting alternate routes, granular decelerate/accelerated speeds recommendations, accident updates, planned maintenance along with growth projections, congested routes or intersections. Traffic flow management may be directed towards traffic lights at one or more traffic intersections to adjust the general traffic flow light timing at traffic intersections. Traffic flow management may also be directed towards specific vehicles to suggest alternate routes, and granular decelerate/accelerated speeds recommendations.

According to one possible implementation, the IEEE 802.11 protocol may be utilized for communication with palmtop computers, laptop computers, personal digital assistants (PDAs) and Internet mobile phones. The 802.11 standard specifies two modes of operation: (i) an infrastructure mode where an access point provides the link between wireless stations and wireline legacy infrastructure, and (ii) an ad-hoc mode where there is no access point, by using hubs to collect real time data that is feed into a central processing complex each tVector Hub contributes to the distributed management and control of the entire network.

According to one possible implementation, the operating system is built on a Unix platform. According to this non-limiting implementation, verifications of tVector Hubs occur routinely in sequential random patterns. Notifications are sent out to each hub for authentication purposes, to verify integrity of each unit using a cryptic VPN connection. The network may utilize Crypsis Tokenization. Each tVector Hub is routinely verified by a data push for original data composition. On deployment the token is placed within each unit's core operating system. If the unit loses power, is hit with a power surge, or has otherwise been compromised, then the unit data may rolled back.

Test tokens are sent to verify operational areas for integrity. If any give units any of units are not same as its original encrypted token, the unit is rolled back.

Off-line for maintenance, OS updates, hardware failures/software updates may be propagated throughout the system.

The data from tVector Hubs may be sent via one or more token sets in OS for security purposes, originally implanted.

Figure 1B:
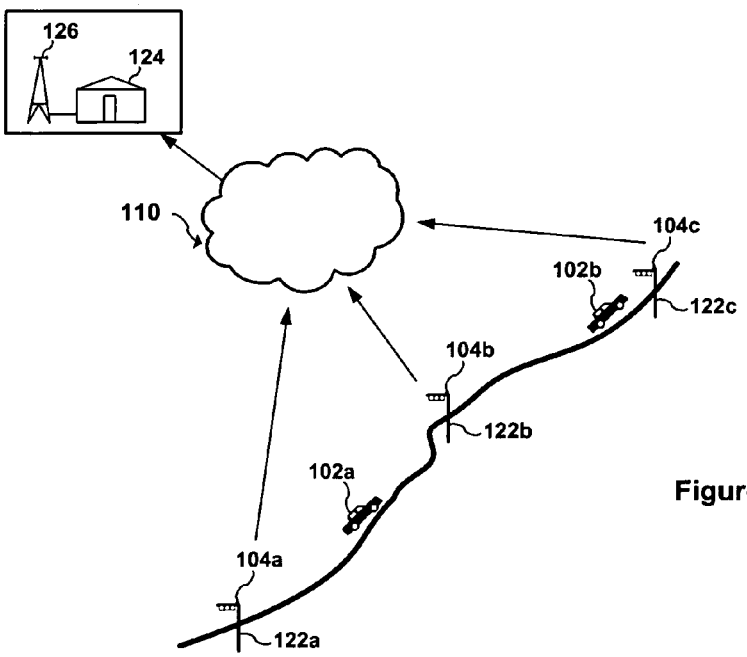

Referring to FIGS. 1A-1B, block diagrams illustrating a method for monitoring and managing traffic flow in accordance with an embodiment of the present invention are shown. According to this embodiment, the system includes one or more computers 112 in communication with one or more databases 114. The one or more computers 112 are in communication via a network 110 with a one or more vehicles 102, one or more receiving stations 104, one or more governmental agencies 106, and optionally other sources 108. The one or more vehicles 102 are equipped with one or more sensors that periodically transmit data to the one or more receiving stations 104. The transmitted data includes geographic position data for the one or more sensors onboard the one or more vehicles 102. As shown in FIG. 1B, as the one or more vehicles (102*a* and 102*b*) travel along one or more roadways, they periodically come within range of one or more receiving stations (104*a*-104*c*) attached to respective one or more roadway locations (122*a*-122*c*). The one or more sensors on the one or more vehicles (102*a* and 102*b*) may include RFID and/or GPS modules. Data from the one or more vehicles (102*a* and 102*b*) is transmitted via the one or more sensors on the one or more vehicles (102*a* and 102*b*) to the one or more receiving stations (104*a*-104*c*) within range. The data is transmitted to one or more computers 112 in communication with one or more databases 114. Without limitation, such transmission may utilize existing wired or wireless networks or new communication networks. For instance, the data may be communicated wirelessly to a communication tower 126 which is then relayed to the one or more computers 112.

The one or more computers 112 calculate the likely individual routes of the one or more vehicles (102*a* and 102*b*) and the estimated transit time based on the received geographic positioning data received respectively from the vehicles. The individual routes and times are refined as new geographical positional data for those vehicles is periodically received. This may be achieved by a number of different positional system technologies which are available for calculating geographical positional information. The road data used in the present invention is generally in the form of a data file.

Figure 2A:
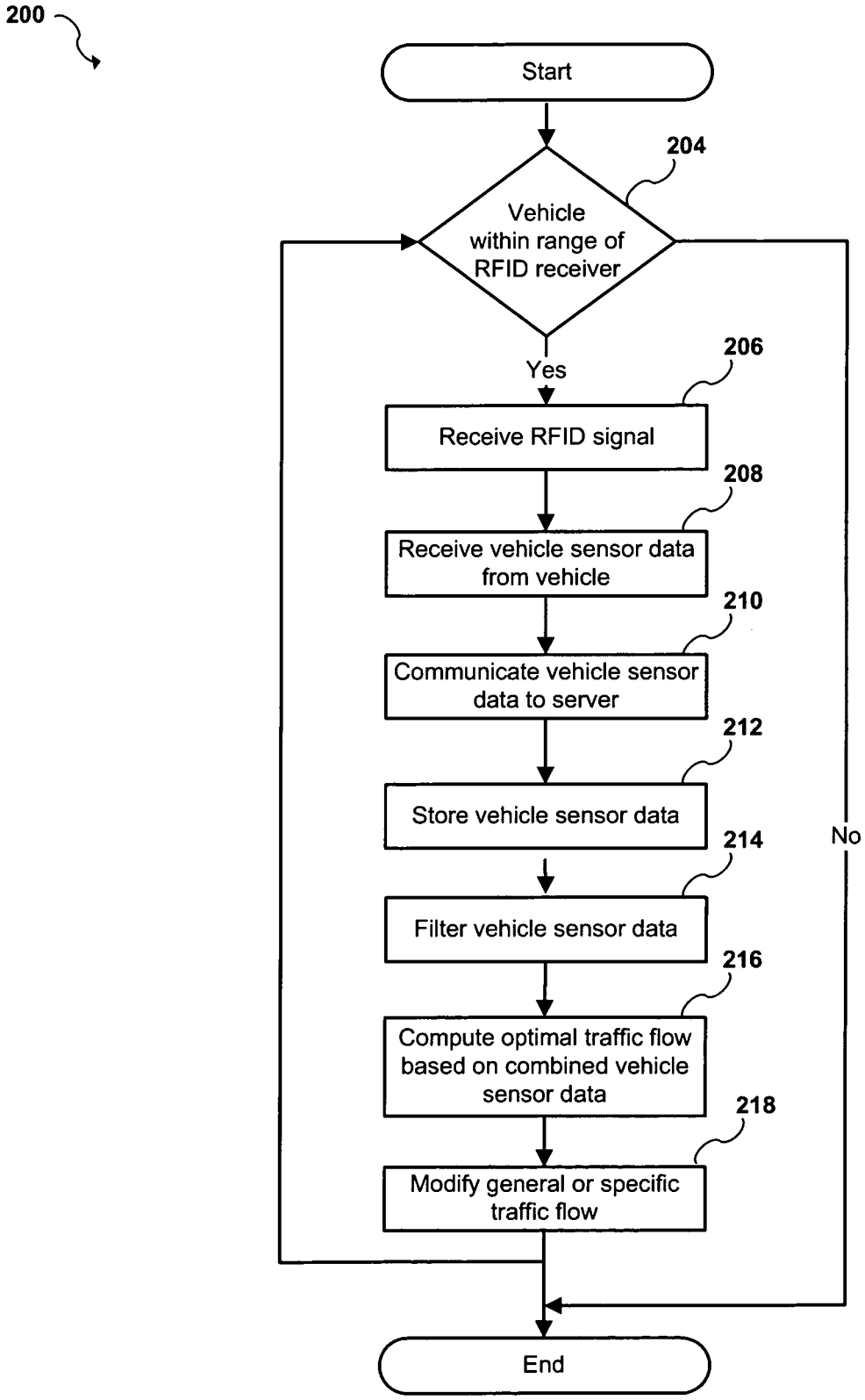
FIGS. 2A-2B are flow charts illustrating a method for monitoring and managing traffic flow in accordance with an embodiment of the present invention
Figure 2B:
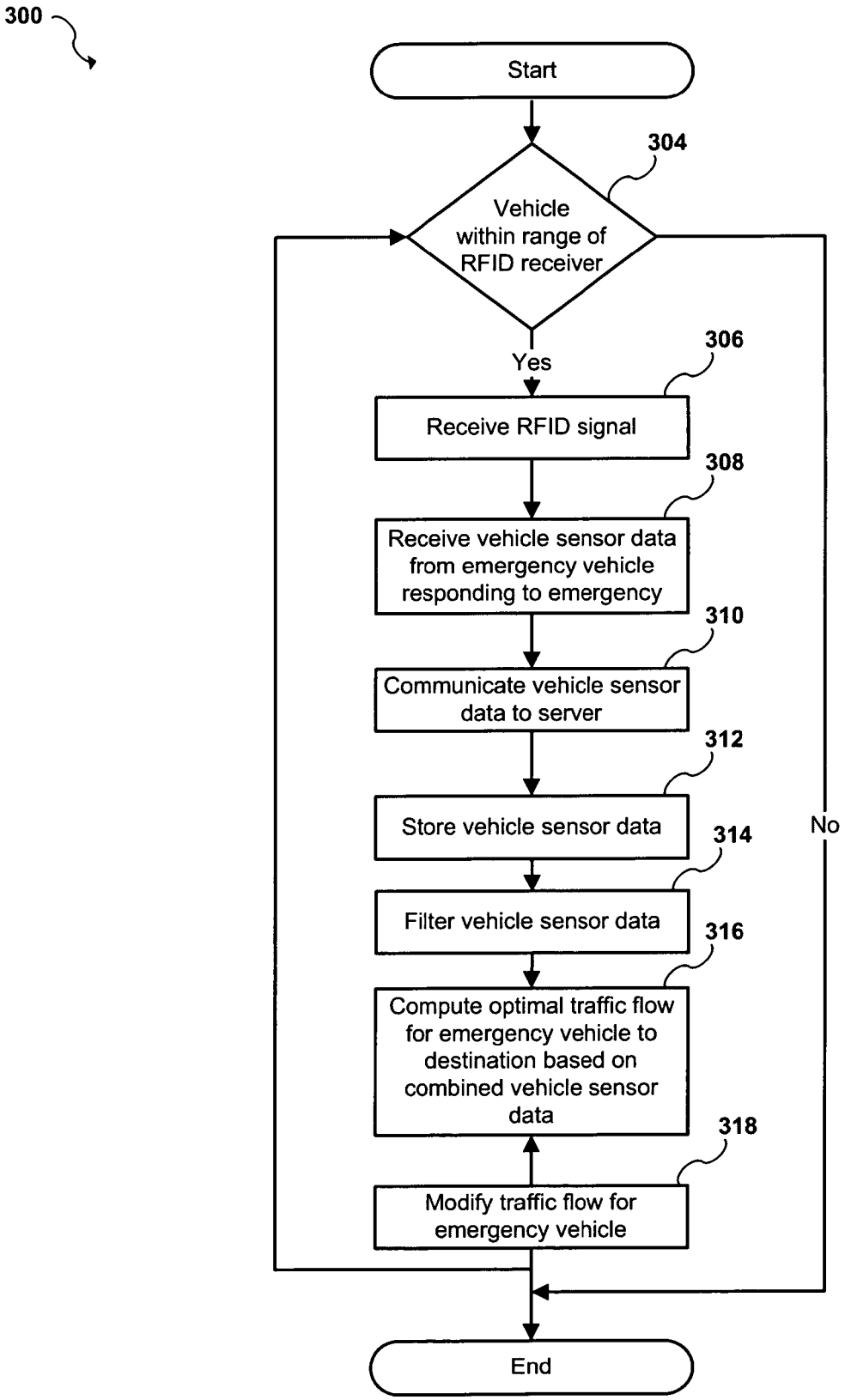

Referring to FIGS. 2A-2B, flow charts illustrating a method for monitoring and managing traffic flow in accordance with an embodiment of the present invention are shown. As shown at block 202, if a vehicle is within range of a receiver, then processing continues at block 206, where a signal is received from the vehicle. The receiver may be an RFID, RFIDGPS or other wireless receiver or the like. The vehicle sensor data is received by the receiver and communicated to the server at blocks 208-210. At block 212, the vehicle sensor data is stored in a database along with data received from other vehicles, wireless towers and the like. At block 214, the geographical positional data is filtered to ensure data integrity. An optimal traffic flow pattern is periodically calculated at block 216 using vehicle sensor data from multiple vehicles over time. At block 218, traffic flow modification information is sent to manage and modify the general or specific traffic flow. This traffic flow modification information may be directed towards traffic lights at one or more traffic intersections to adjust the general traffic flow light timing at traffic intersections. Traffic flow modification may also be directed towards specific vehicles to suggest alternate routes, and granular decelerate/accelerated speeds recommendations.

An indication of road congestion may be calculated as the difference between the calculated average speed and the normal average speed. Further, by counting all of the vehicles using a particular road, it is possible to estimate the volume of the traffic on the road.

As shown at block 302 of FIG. 2B, if an emergency vehicle responding to an emergency is within range of a receiver, then processing continues at block 306, where a signal is received from the emergency vehicle. The receiver may be an RFID or other wireless receiver or the like. The vehicle sensor data is received by the receiver and communicated to the server at blocks 308-310. At block 312, the vehicle sensor data is stored in a database along with data received from other vehicles. At block 314, the geographical positional data is filtered to ensure data integrity. An optimal traffic flow pattern is periodically calculated for the emergency vehicle to reach its desired destination at block 316. At block 318, traffic flow modification information is sent to manage and modify the traffic flow for the emergency vehicle to optimally reach its desired destination. This traffic flow modification information is typically directed towards traffic lights at one or more traffic intersections to adjust the general traffic flow light timing at traffic intersections.

According to one embodiment, a user interface is provided to allow user access to the geographical position data over a computer network. Historical geographical position data or any other stored on the server may then be viewed over the network, such as the Internet.

The present invention includes a computer program which may be hosted on a storage medium or other computer readable medium and includes instructions which perform the processes set forth herein. The storage medium or other computer readable medium can include, but is not limited to, any type of disk including floppy disks, optical disks, CD-ROMs, magneto-optical disks, ROMs, RAMs, EPROMs, EEPROMs, flash memory, magnetic or optical cards, or any type of media suitable for storing electronic instructions.

Obviously, many other modifications and variations of the present invention are possible in light of the above teachings. The specific embodiments discussed herein are merely illustrative, and are not meant to limit the scope of the present invention in any manner. It is therefore to be understood that within the scope of the disclosed concept, the invention may be practiced otherwise then as specifically described.

The invention claimed is:

1. A system configured to manage monitored traffic flow, the system comprising:

a plurality of remote devices arranged in a plurality of vehicles, wherein the remote devices are equipped with AVICS;

wherein one or more of the plurality of remote devices comprise an RFIDGPS module a plurality of remote mobile communication devices strategically placed along roadway locations and in communication with the plurality of the remote devices, wherein the remote mobile communication devices are equipped with AVICS;

wherein one or more of the plurality of remote mobile communication devices comprise an RFIDGPS module;

a central server;

a network interface in communication with the central server and the plurality of remote mobile communication devices over a network, the network interface being configured to send and receive traffic data through tVector Hubs utilizing encrypted data transfer utilizing Crypsis Tokenization, wherein the traffic data includes vehicle location information consisting of fuel consumption data, maintenance information, latitude, longitude, mechanical information from onboard vehicle processors, emergency information, and other vehicle information a shared database in communication with the central server;

wherein the central server is configured to:

receive traffic data from the plurality of remote devices over the network;

update traffic data in the shared database;

continuously calculate an optimal traffic flow for one or more of vehicles traveling along one or more roadways based on the updated traffic data, and transmit timing adjustments over the network to one or more traffic light intersections based on the optimal traffic flow calculations and automatically presenting alternate routes, granular decelerate/accelerated speeds recommendations, accident updates, planned maintenance along with growth projections, congested routes or intersections.

2. A computer program product embodied on a non-transitory computer readable medium configured to manage monitored traffic flow executed by a computer, the computer program product comprising:

a plurality of remote devices arranged in a plurality of vehicles, wherein the remote devices are equipped with AVICS;

wherein one or more of the plurality of remote devices comprise an RFIDGPS module;

a first computer code for receiving traffic data from a plurality of remote mobile communication devices strategically placed along roadway locations and in communication with the plurality of the remote devices, wherein the remote mobile communication devices are equipped with AVICS;

wherein one or more of the plurality of remote mobile communication devices comprise an RFIDGPS module;

a central server;

a network interface in communication with the central server and the plurality of remote mobile communication devices over a network, the network interface being configured to send and receive traffic data through tVector Hubs utilizing encrypted data transfer utilizing Crypsis Tokenization, wherein the traffic data includes vehicle location information consisting of fuel consumption data, maintenance information, latitude, longitude, mechanical information from onboard vehicle processors, emergency information, and other vehicle information;

a second computer code for updating traffic data in a shared database;

a third computer code for periodically calculating an optimal traffic flow for one or more of vehicles traveling along the one or more roadways based on the updated traffic data; and a fourth computer code for transmitting timing adjustments over the network to one or more traffic light intersections based on the optimal traffic flow calculations and automatically presenting alternate routes, granular decelerate/accelerated speeds recommendations, accident updates, planned maintenance along with growth projections, congested routes or intersections.

* * * * *